US005414196A

United States Patent [19]

Jennings

[11] Patent Number: 5,414,196

[45] Date of Patent: May 9, 1995

[54] METHOD OF DECONTAMINATING A CEMENTITIOUS SURFACE

[75] Inventor: Howard T. Jennings, Chester, United Kingdom

[73] Assignee: British Nuclear Fuels plc, Warrington, England

[21] Appl. No.: 961,663

[22] Filed: Oct. 16, 1992

[30] Foreign Application Priority Data

Oct. 18, 1991 [GB] United Kingdom ..... 9122147

[51] Int. Cl.[6] ..... G21F 9/00

[52] U.S. Cl. ..... 588/1; 134/2; 435/262; 435/262.5; 435/264; 976/DIG. 392; 588/3

[58] Field of Search ..... 134/2; 205/128; 976/DIG. 392; 435/262, 262.5, 264; 588/1, 3

[56] References Cited

U.S. PATENT DOCUMENTS

| | | | |
|---|---|---|---|
| 4,655,794 | 4/1987 | Richardson et al. | 51/293 |
| 4,861,519 | 8/1989 | Tusa et al. | 252/633 |
| 4,871,673 | 10/1989 | Rehm et al. | 435/262 |
| 5,011,708 | 4/1991 | Kelly et al. | 427/443.1 |
| 5,047,152 | 9/1991 | Francis et al. | 210/611 |
| 5,152,341 | 10/1992 | Kasevich | 166/248 |
| 5,264,018 | 11/1993 | Koenigsberg et al. | 71/63 |

FOREIGN PATENT DOCUMENTS

| | | |
|---|---|---|
| 0224510B | 2/1991 | European Pat. Off. . |
| 2640528 | 6/1990 | France . |
| 4014854A1 | 11/1991 | Germany . |

OTHER PUBLICATIONS

Bors, J., et al., Sorption Studies of Radioiodine on Soils with Special References to Soil Microbial bio-mass, 1991, Radio Chim. Acta, 52-53 (Pt. 2), 317-25.

Wolf, M., et al., Microbial Degradation of Bitumen Matrix Used in Nuclear Waste Repositories, 1991, Naturwissenschaften, 78(9), 414-17.

Ait Abdellah, N., et al., Microbial Degradation of Bitumen Used for the Conditioning of Low and Medium Level Radioactive Waste, 1984, Radioact. Waste Manage., 13 (Terl., Eval., Shallow Land Burial Low Med. Radioact. Waste Forms), 163-81.

*Primary Examiner*—Ngoclan T. Mai

*Attorney, Agent, or Firm*—Nixon & Vanderhye

[57] ABSTRACT

A cementitious surface contaminated with a radioactive substance is decontaminated by applying a micro-organism to the surface to degrade the surface. The residue which contains the radioactive substance is then removed by suction, scraping, brushing or abrasion blasting. The micro-organism might comprise an aerobic sulphur oxidising bacteria, or an anaerobic sulphate reducing bacteria, or a mixture thereof. Action of the micro-organism can be stopped as necessary by heating, or by depriving the micro-organism of nutrients.

16 Claims, No Drawings

METHOD OF DECONTAMINATING A CEMENTITIOUS SURFACE

This invention relates to the decontamination of a cementitious surface, and more particularly to a surface contaminated with at least one radioactive substance.

In the nuclear industry a cementitious material such as concrete is commonly used to retain radioactive substances. During this use the surface of the concrete can become impregnated with the radioactive substances, or the radioactive substances can become chemically bound with the concrete at the surface. Before the concrete is subsequently stored in a suitable waste disposal site, it is desirable to remove the radioactive substances from the surface.

According to the present invention there is provided a method of decontaminating a cementitious surface contaminated with at least one radioactive substance, the method comprising applying a micro-organism to the surface in conditions conducive to growth of the micro-organism to degrade the surface and thereby release a material comprising the radioactive substance, and removing the released material from the surface.

Preferably, the micro-organism comprises a species of thiobacillus such as thiobacillus thiooxidans, and, desirably the conditions include a sulphur containing nutrient source at the surface.

It may be necessary to apply the nutrient source before or at the same time as the application of the thiobacillus micro-organism. Alternatively, the cementitious surface itself may contain a said nutrient source.

Removal of the released material may be effected for example, by vacuum suction, by scraping or brushing, or by abrasion blasting.

The conditions to induce growth of the micro-organism might include adjustment of:

humidity temperature electromagnetic radiation, e.g. visible light, infra red, ultraviolet acid forming material A dry powder application of the nutrient source may suffice, the humidity being arranged to diffuse the nutrients to the micro-organism.

Once the concrete surface has been satisfactorily decontaminated, the micro-organism may be stopped by heating, or by depriving it of essential nutrients.

The removed material containing the radioactive substance should be high in inorganic material and, therefore, be appropriate for encapsulation in concrete or by vitrification.

In an application of the invention, core samples are taken to ascertain the depth of the contamination. Then a layer of thiobacillus thiooxidans micro-organism is applied to the concrete surface in conditions of temperature, humidity, and light, conducive to growth of the micro-organism. The concrete contains sufficient natural sulphur to avoid the need for the application of a nutrient source. Otherwise a source such as sulphuric acid would be applied. When a sufficient depth of degradation of the surface has occurred, the micro-organism is killed by application of intense heat. The resulting concrete powder is removed by suction and eventually encapsulated in concrete for disposal.

Although the invention has been described in relation to the use of thiobacillus thiooxidans, it might be possible to use micro-organisms that cause less severe degradation of the concrete, such as thiobacillus neapolitanus, or thiobacillus intermedius.

The thiobacillus genus constitute aerobic sulphur oxidising bacteria (SOB). Degradation of concrete is also possible with anaerobic sulphate reducing bacteria (SRB). Where the oxygen conditions fluctuate a mixture of SOB and SRB micro-organisms might be applied.

We claim:

1. A method of decontaminating a cementitious surface contaminated with at least one radioactive substance, the method comprising:

(a) applying a decontaminating agent to the contaminated cementitious surface, thereby treating the surface so as to release a material containing the radioactive substance, and (b) removing said released material from the surface, wherein said decontaminating agent is a micro-organism which is applied to the surface under conditions conducive to the growth of the micro-organism and wherein said surface is biodegraded by the micro-organism thereby releasing a material containing the radioactive material.

2. A method as claimed in claim 1, wherein the conditions to induce growth of the micro-organism include adjustment of humidity, temperature, electromagnetic radiation, and acid forming material.

3. A method as claimed in claim 1, wherein the micro-organism comprises aerobic sulphur oxidizing bacteria.

4. A method as claimed in claim 3, wherein the micro-organism comprises a species of thiobacillus.

5. A method as claimed in claim 4, wherein the micro-organism comprises thiobacillus thioxidans, or thiobacillus neapolitanus, or thiobacillus intermedius.

6. A method as claimed in claim 1, wherein the micro-organism comprises anaerobic sulphate reducing bacteria.

7. A method as claimed in claim 3, wherein the micro-organism comprises a mixture of aerobic sulphur oxidizing bacteria and anaerobic sulphate reducing bacteria.

8. A method as claimed in claim 3, wherein the conditions include a sulphur-containing nutrient source at the surface.

9. A method as claimed in claim 8, wherein the nutrient source is applied before the application of the micro-organism.

10. A method as claimed in claim 8, wherein the nutrient source is applied at the same time as the micro-organism.

11. A method as claimed in claim 8, wherein the nutrient source is applied as a dry powder, the humidity being arranged to diffuse the nutrients to the micro-organism.

12. A method as claimed in claim 3, wherein the cementitious surface itself contains a sulphur-containing nutrient source.

13. A method as claimed in claim 1, including subsequently stopping the growth of the micro-organism by heating.

14. A method as claimed in claim 1, including subsequently stopping the growth of the micro-organism by depriving the micro-organism of nutrients.

15. A method as claimed in claim 1, wherein removal of the released material is effected by vacuum suction, or scraping, or brushing, or abrasion blasting.

16. A method as claimed in claim 1, wherein the released material containing the radioactive substance is high in inorganic material, and including immobilising the inorganic material by encapsulation of the released material in concrete, or by vitrification.

* * * * *

UNITED STATES PATENT AND TRADEMARK OFFICE

CERTIFICATE OF CORRECTION

PATENT NO. : 5,414,196
DATED : May 9, 1995
INVENTOR(S) : Howard T. Jennings and Harry Eccles

It is certified that error appears in the above-identified patent and that said letters patent is hereby corrected as shown below:

On the title page: [75], it should read
--Inventors: Howard T. Jennings, Chester, United Kingdom and
Harry Eccles, Preston, United Kingdom--

Signed and Sealed this
Twenty-fifth Day of July, 1995

Bruce Lehman

*Attest:*

BRUCE LEHMAN

*Attesting Officer*

*Commissioner of Patents and Trademarks*